US006220830B1

(12) United States Patent
Bzorgi

(10) Patent No.: US 6,220,830 B1
(45) Date of Patent: Apr. 24, 2001

(54) HIGH EFFICIENCY BLOWER AND SOLAR-POWERED SOIL REMEDIATION SYSTEM

(75) Inventor: Fariborz M. Bzorgi, Knoxville, TN (US)

(73) Assignee: Bechtel National, Inc., San Francisco, CA (US)

( * ) Notice: Subject to any disclaimer, the term of this patent is extended or adjusted under 35 U.S.C. 154(b) by 0 days.

(21) Appl. No.: 09/324,988

(22) Filed: Jun. 2, 1999

Related U.S. Application Data

(60) Provisional application No. 60/118,596, filed on Feb. 4, 1999.

(51) Int. Cl.[7] ..... F04B 17/00
(52) U.S. Cl. ..... 417/411; 417/424.1
(58) Field of Search ..... 417/411, 423.15, 417/424.1, 366

(56) References Cited

U.S. PATENT DOCUMENTS 2,782,982 * 3/1957 Merz ..... 417/423.15
4,044,750 * 8/1977 Zeigler ..... 417/411
4,593,179 * 6/1986 Schulz et al. ..... 219/370
4,662,268 * 5/1987 Beavers ..... 98/39.1
4,734,017 * 3/1988 Levin ..... 417/366
4,805,697 * 2/1989 Fouillout et al. ..... 166/265

OTHER PUBLICATIONS

Passive Soil Vapor Extraction, www.llnl.gov/IPand C/op96/03/3i~pas.html, Lawrence Livermore National Laboratory, Sep. 1998.*

* cited by examiner

*Primary Examiner*—Timothy S. Thorpe
*Assistant Examiner*—Michael K. Gray
(74) *Attorney, Agent, or Firm*—Townsend & Townsend & Crew LLP

(57) ABSTRACT

A high efficiency blower (14) includes a body (18) having an inner venturi surface (22) aligned with a flow axis (38) through the body. A motor/fan assembly (36) includes a motor (42) and a fan blade assembly (46) mounted to a shaft (48) extending from the motor. Several flow-straightening supports (40) support the motor/fan assembly within the body and locate the fan blades at the throat (28) of the venturi surface. High efficiency is created by mounting the motor fan assembly within the venturi surface and by the use of the flow-straightening supports. The high efficiency blower may be used as a part of a relatively simple, inexpensive, self-contained soil remediation system (2) which requires no external source of power and very little upkeep.

8 Claims, 4 Drawing Sheets

HIGH EFFICIENCY BLOWER AND SOLAR-POWERED SOIL REMEDIATION SYSTEM

CROSS REFERENCE TO RELATED APPLICATION

This application claims the benefit of Provisional Patent Application Ser. No. 60/118,596 filed Feb. 4, 1999.

BACKGROUND OF THE INVENTION

Soils contaminated by, for example, hydrocarbons can often be remediated, that is cleaned, by forcing air (and thus oxygen) through wells into the contaminated underground regions. This injection may be in conjunction with the introduction of other gases, liquids or micro-organisms.

Soil remediation systems may also use forced air venting, also called soil vapor extraction (SVE). With this technique gas within the unsaturated contaminated soil matrix is extracted using vacuum applied at one or more extraction wells. Pressure gradients within the unsaturated zone induce a convection air flow through the porous soil matrix. The extent of the vacuum influence is determined by the soil properties. As the contaminated soil gas is removed, clean air from the surface is drawn into the contaminated zone; thus organic compounds to be volatilized, depending upon their vapor pressures.

Current SVE methods use gasoline, electric or hydraulically-driven positive displacement blower systems to pull the air and volatilized compounds from the wells. The typical blower system consists of a positive-displacement blower driven by a drive motor, a vacuum breaker, pressure relief valve, temperature switches, pressure and temperature gauges, intake filters and exhaust silencers. These SVE systems are typically mounted on skids since they are very heavy and they will only be left in place for a short period of time. There are several problems with conventional SVE systems. The blowers are noisy, and they are notorious for their inefficiency. Conventional SVE systems are expensive to purchase, to operate and to maintain. At the end of the clean-up procedure, SVE's must be disposed of. Vapor exhausted from the blower is above about 180° Fahrenheit, posing a safety concern. Conventional SVE systems require large diameter piping between the blower skid and the wells. This above ground piping creates obstacles as well as being unsightly. Below grade piping is expensive and may require cutting through concrete slabs. A conventional SVE system often requires use of a crane to set up the system and typically entails a complicated startup procedure. Because of their many problems and drawbacks, potential users often decide against installing skid mounted SVE systems.

Conventional air injection systems suffer from many of the same drawbacks as conventional SVE systems.

SUMMARY OF THE INVENTION

The present invention is directed to a high efficiency blower finding particular utility for use with a solar-powered soil remediation system, as well as other end uses. The high efficiency is created by mounting a motor fan assembly within a venturi surface and by the use of flow-straightening supports aligned along the flow axis through the body of the blower.

The blower includes a body having an inner venturi surface aligned with a flow axis through the body. The venturi surface has first and second ends and a throat between the two ends. A motor/fan assembly is mounted within the body by at least one flow-straightening support.

The motor/fan assembly includes a motor and a fan blade assembly mounted to a shaft extending from the motor. The fan blade assembly has at least one fan blade. The support extends between the motor/fan assembly and the body. The fan blade is preferably located generally at the throat of the venturi surface. The flow-straightening support has leading and trailing edges and first and second lateral sides extending between the edges. The lateral sides are oriented generally parallel with the flow axis.

Another aspect of the invention relates to the high efficiency blower being powered by a solar panel through an electric storage and control assembly. This permits operations, such as soil remediation, to be conducted using a relatively simple, inexpensive, self-contained system which requires no external source of power and very little upkeep. In one embodiment the high-efficiency blower is capable of moving at least 170 cfm of air at about 2000 fpm using no more than about 7.5 watts of power.

One of the primary advantages of the invention is that it can be quite inexpensive to purchase and use. For example, assume six wells will be needed at a site. The total cost for purchasing, operating and maintaining six soil remediation systems, one for each of the six wells, made according invention is estimated to be about $20,000.00 over two years of operation. This can be compared with a total cost of about $240,000.00 to operate a single conventional SVE system connected to the six wells and operated for two years. This cost saving is largely because with a soil remediation system made according to the invention, a major cost will be the soil remediation system itself and the cost for the six wells. There are very few other costs involved. The simplicity of the soil remediation system made according to the invention can eliminate the need for regular maintenance; it can be installed by a single operator at an existing well in a relatively short period of time. Using solar power instead conventionally generated electricity not only eliminates the cost of the electricity itself but also pollution created in generating and transmitting the electricity. By using a separate soil remediation system for each well, the need for pipes from several wells to a single system is eliminated resulting in substantial cost savings.

The housing for a solar-power blower system can be fabricated from a structural frame covered with UV protected ABS plastic. The ABS plastic is economical and dent resistant. Other materials, such as anodized aluminum sheet, can also be used. The structural frame can be made from square steel tubing; other materials, such as aluminum or stainless steel in the same or other shapes could also be used meet various site requirements. The housing may be designed to hold a solar panel at an appropriate angle, which may be fixed or adjustable. The housing preferably acts as a container for the electronics and the blower.

The solar panel and electricity storage and control assembly may be conventional components using a deep charge/deep discharge battery. It is preferred that the system be designed such that the blower is supplied with uninterrupted power for night and overcast day operation. During normal daylight operation the system is preferably designed to not only operate the blower, but also trickle charge a backup battery for night time operation to offer the operator extended use performance.

The blower can be connected to more than one well. However, the relatively low cost of the invention makes it most suited for using a system for each well; this eliminates the need for long lengths of above ground or below ground piping from the various wells to the system, together with the cost associated with such piping.

Other features and advantages of the invention will appear from the following description in which the preferred embodiment has been set forth in detail in conjunction with the accompanying drawings.

DESCRIPTION OF THE SPECIFIC EMBODIMENTS

Figure 2:
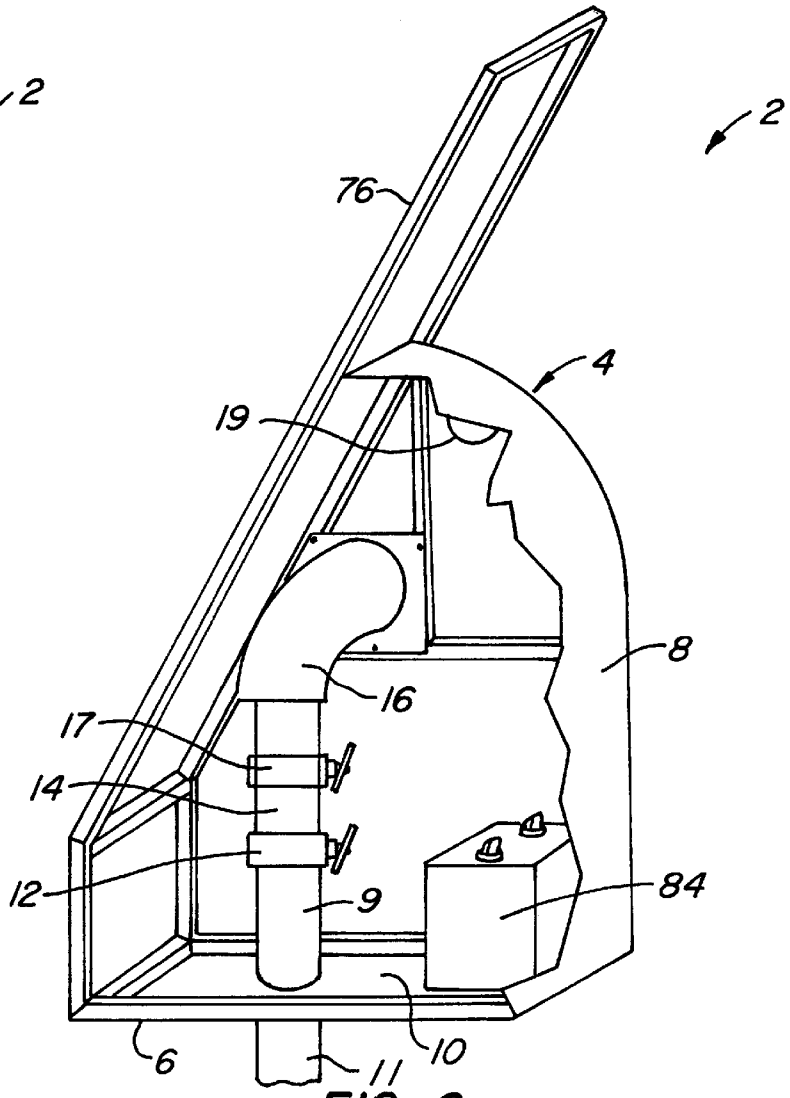
FIG. 2 shows the system of FIG. 1 with portions broken away to illustrate the interior.
Figure 1:
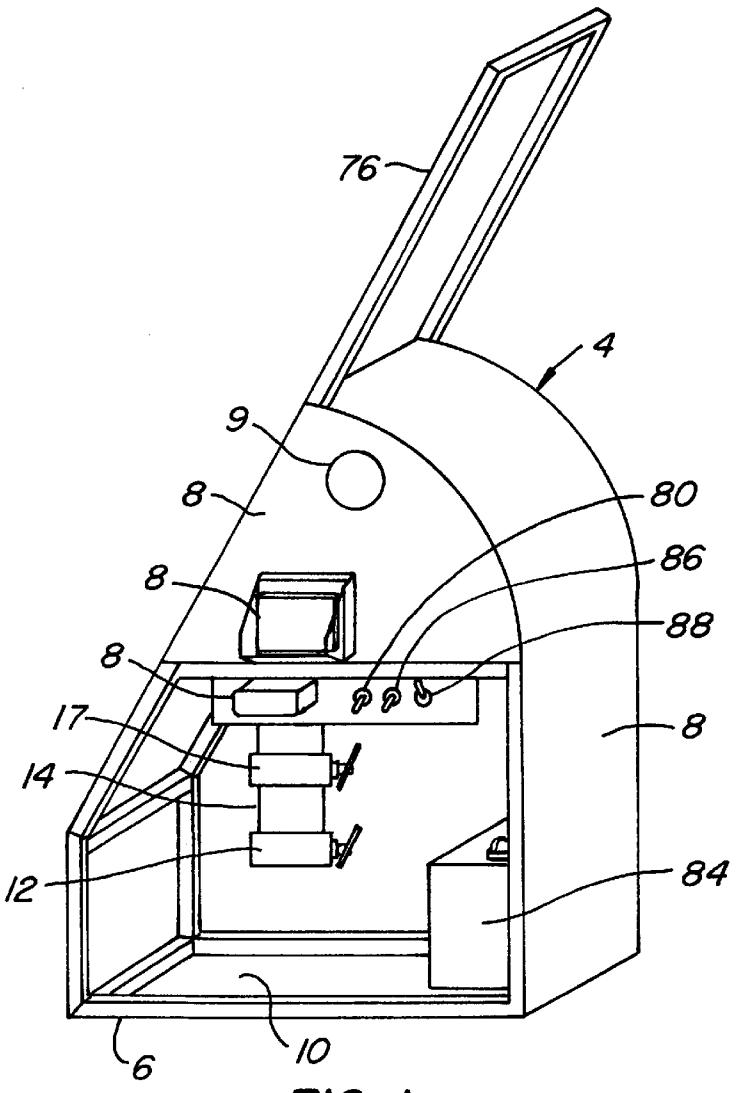
FIG. 1 is an overall view of a solar-powered soil remediation system with a side panel removed.

FIG. 1 illustrates a solar-powered soil remediation system 2 made according to the invention. System 2 includes a housing 4, a front panel of the housing being omitted in FIG. 1 to illustrate some of the components of system 2. Housing 4 includes a tubular frame 6 made of square steel tubes welded together to form the frame. Sheets or panels of UV-protected ABS plastic material 8 are used to cover frame 6. Housing 4 can be made of other materials and in other ways, such as using an all metal construction, all plastic construction with an integral framework. Materials other than steel for tubular frame 6, such as stainless steel or aluminum, could also be used. Housing 4 typically has an open bottom 10 to permit housing 4 to be mounted over an upstanding pipe 9 extending from a remediation well 11, pipe 9 and well 11 shown in FIG. 2 only. System 2 is connected to the upstanding pipe of the well by a clamp 12 mounted to one end of a blower 14, the other end of the blower coupled to the ambient atmosphere through a conduit 16 by a second clamp 17. Housing 4 also includes a pair of ambient air vents 19 near the peak of the housing.

Figure 3:
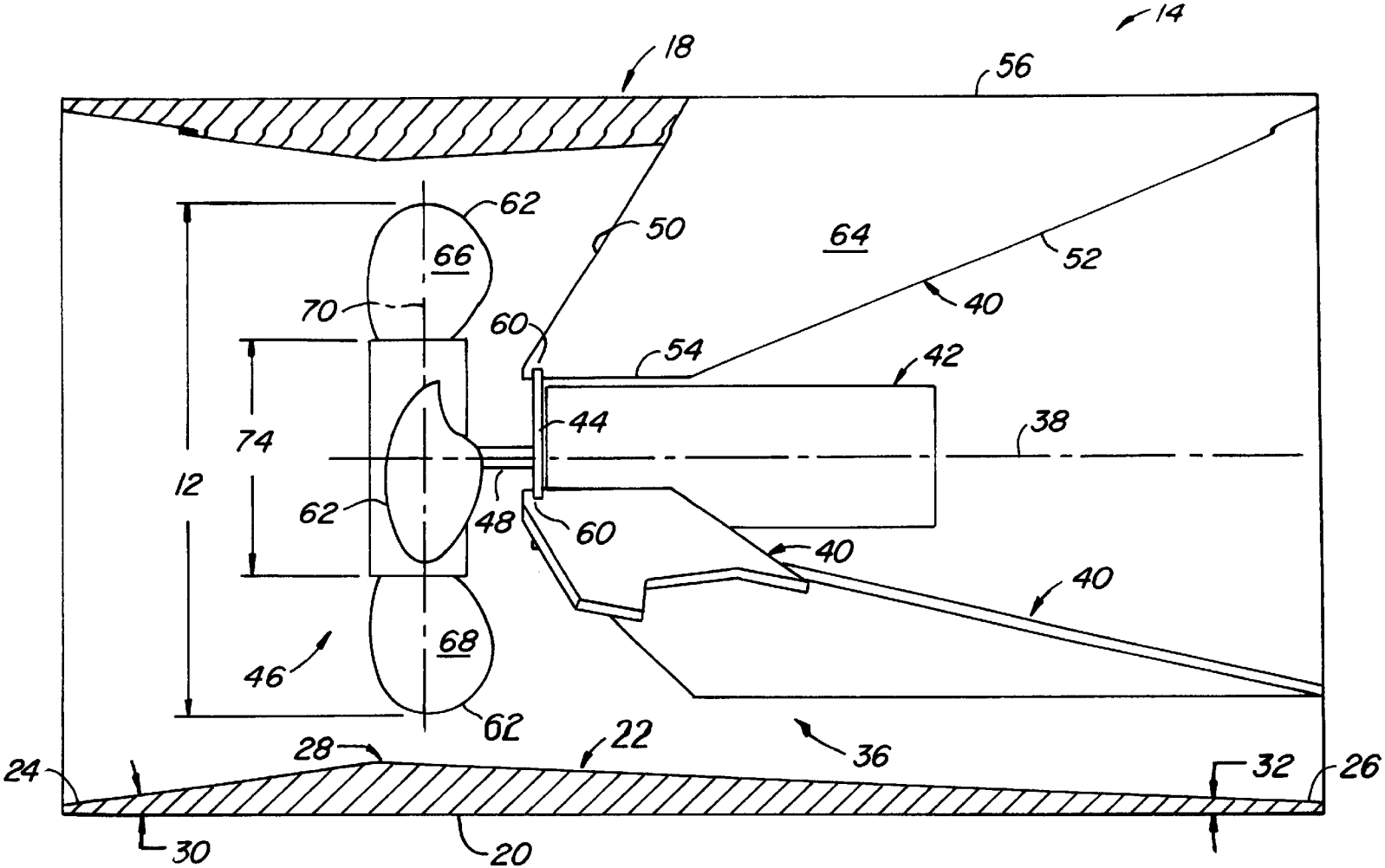
FIG. 3 is an enlarged side cross-sectional view of the blower of FIG. 1.
Figure 4:
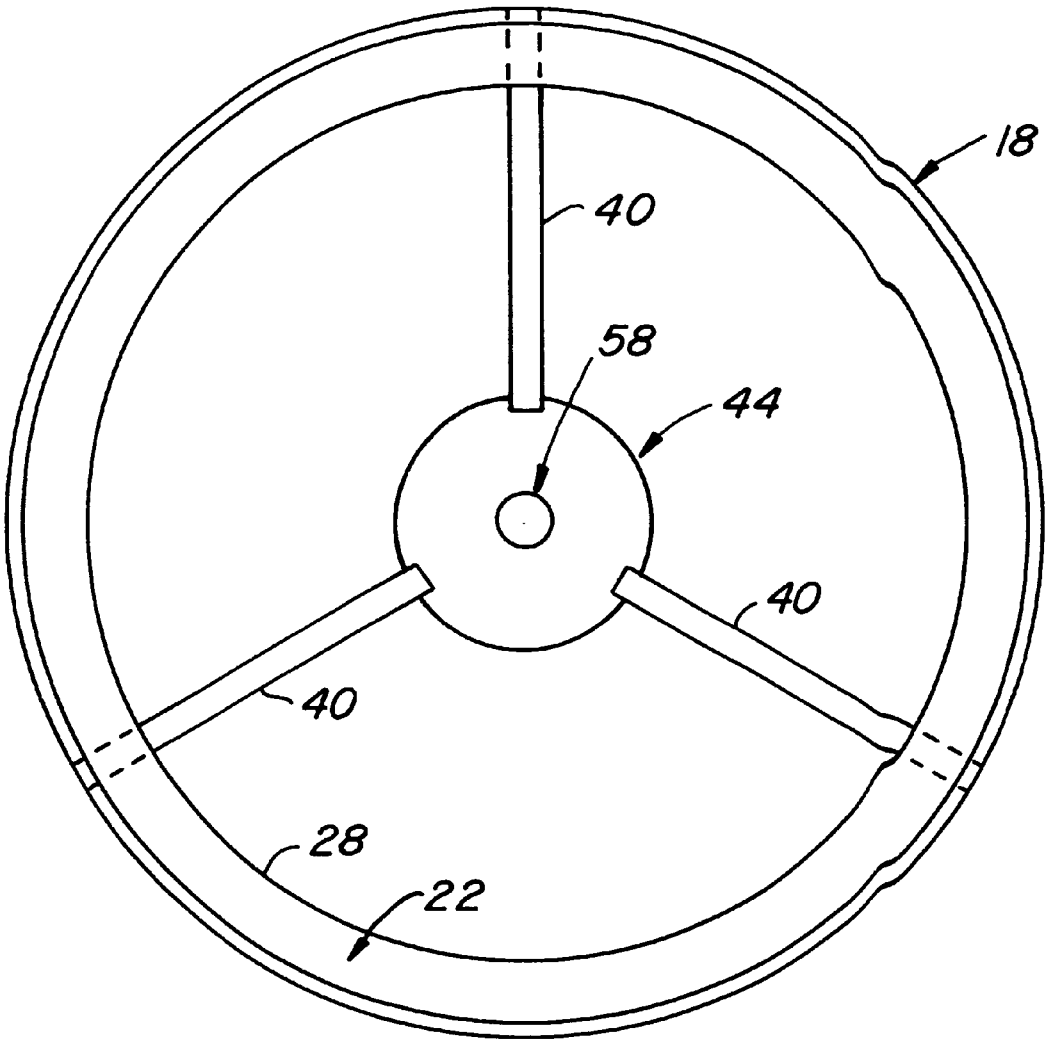
FIG. 4 is an end view of the blower of FIG. 3 with the motor/fan assembly removed.

A key component of system 2 is blower 14, shown in more detail in FIGS. 3 and 4. Blower 14 includes a generally cylindrical body 18 defining a cylindrical outer surface 20 and a tapered, inner venturi surface 22. Venturi surface 22 extends from a first end 24 to a second end 26, the venturi surface tapering radially inwardly from the ends towards a throat 28 at first and second angles 30, 32 respectively. In a preferred embodiment body 18 is about 8 inches (20 cm) long and about 4 inches (10 cm) in diameter with a wall thickness at each end 24, 26 of about 0.060 inch (1.5 mm). Also, in a preferred embodiment angles 30 and 32 are about 8° and 3°, respectively. Other sizes and proportions may also be use.

Blower 14 also includes a motor/fan assembly 36 mounted centrally within the interior of blower 14 along a flow axis 38 by three evenly spaced apart, flow-straightening supports 40 extending upwardly from a mounting plate 44. Assembly 36 also includes a motor 42 mounted to mounting plate 44 at one end and a fan blade assembly 46 mounted to a motor drive shaft 48, extending from motor 42. Shaft 48 and assembly 46 are aligned with and centered on flow axis 38. Each flow straightening support 40 includes a leading edge 50, a trailing edge 52, both oriented at angles to flow axis 38, an inner edge 54 and an outer edge 56, both generally parallel to flow axis 38. In a preferred embodiment mounting plate 44 and supports 40 are made of 6061 aluminum plate ⅛ inch (3.2 mm) thick while body 18 is also made of 6061 aluminum. Motor 42 is bolted to plate 44 with shaft 48 passing through a hole 58 formed in plate 44 as shown in FIG. 4. Plate 44 is secured to supports 40 at tips 60, typically by welding, while supports 40 along outer edges 56 are housed with an appropriately sized and positioned slots formed in body 18 and are welded to the body.

Motor/fan assembly 36 can be assembled from conventional components chosen for their high efficiency. For example, motor 42 can be one made by Portescap U.S. Inc. of Hauppauge, N.Y. Fan blade assembly 46 can be one purchased from Advanced Air Mid-America of Murfreesboro, Tenn. As can be seen in FIG. 3, the profile of motor 42 is such that it is relatively long and narrow and thus creates a very small obstruction to the flow of air or other fluids parallel to flow axis 38. In the preferred embodiment leading edge 50 forms an included angle with outer edge 56 of about 122° while trailing edge 52 forms an included angle with outer edge 56 of about 23°. In appropriate cases these may be changed so that, for example, leading and outer edges 50, 56 are at a right angle to one another.

Supports 60 provide both support for assembly 36 and also help to straighten out the otherwise turbulent flow created by the moving blades 62 of the fan blade assembly 46. While this straightening is most pronounced and most effective when the air moves from the left to the right in FIG. 3, that is entering at first end 24 and exiting at second end 26, flow-straightening supports 40 also provide a certain amount of flow-straightening and increased efficiency when motor 42 is reversed to cause air to flow from second end 26 through first end 24. Supports 40 are preferably quite thin, ⅛ inch (3.2 mm) thick in the preferred embodiment. Flow-straightening supports 40 also have relatively large lateral sides 64, which extend between leading and trailing edges 50, 52. Outer edge 56 will preferably be about one third (⅓) to about two thirds (⅔) (one half (½) in the preferred embodiment) the length of body 18, and inner edge 54 will preferably be about one sixteenth (1/16) to about three sixteenths (3/16) (in the preferred embodiment about one eight (⅛)) the length of body 18. This is expected to create a range of sizes of surface areas for lateral sides 64 to provide the desirable flow-straightening without creating unacceptable drag.

As shown in FIG. 3, fan blades 62 are generally aligned with throat 28 of venturi surface 22. Such fan blades 62 have a first fan blade side 66 and a second fan blade side 68. The fan blade sides 66, 68 are typically sized so that each has a surface area which is are equal to or smaller than the surface area of the lateral side 64 of a support 40. In other words, the lateral side 64 of a support 40 has a surface area at least equal to the surface area of a fan blade side. In the preferred embodiment the inside diameter of throat 28 is about 3.83 inches (9.7 cm) while the tip diameter 72 and root diameter 74 of fan blade assembly 46 are about 3.75 inches (9.5 cm) and 1.5 inches (3.8 cm), respectively. Mounting plate 44 has an outside diameter of about 1.125 inches (2.86 cm) while motor 42 has a somewhat smaller diameter of about 1 inch (2.54 cm). Typically, the center 70 of fan blade assembly 46 is located from about 2.25 inches (5.7 cm) forward, that is towards first end 24, to about 5.75 inches (14.6 cm) rearward, that is towards second end 26 of throat 28, with blower 14 of the size described.

Figure 5:
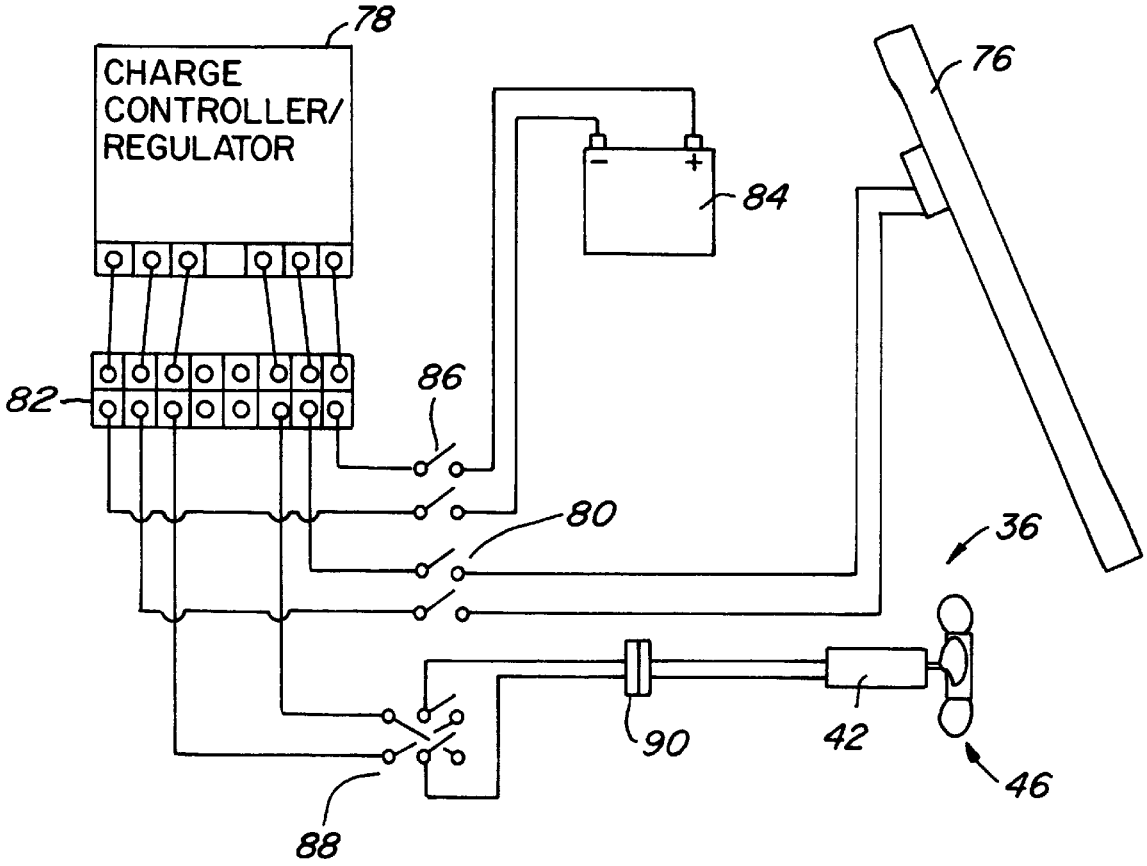
FIG. 5 an electrical schematic diagram of the system of FIG. 1.

FIG. 5 is an electrical schematic showing the various components of system 2. A solar panel 76, such as a 2 feet×4 feet (60 cm×120 cm) solar panel manufactured by Siemens, is mounted to housing 4 and forms one of the walls of the housing. Solar panel 76 is coupled to a charge controller/ regulator 78 through a solar panel switch 80 and a terminal strip 82. A battery 84 is also coupled to controller/regulator 78 through a battery switch 86 and terminal strip 82. Battery 84 and controller/regulator 78 comprise an electricity storage and control assembly. Motor 42 is connected to controller/regulator 78 through a double pole double throw blower switch 88, terminal strip 82 and a connector 90. Connector 90 simplifies the installation of and replacement of motor 42. With the exception of motor/fan assembly 36, the components shown in schematic FIG. 5 can be and typically are conventional components.

In use, solar-powered soil remediation system 2 is mounted over the upstanding end of a remediation well and clamp 12 is secured to the open upper end of the well. Blower switch 88 is placed in the proper position to cause fan blade assembly 46 to rotate in a chosen direction. Assuming there is sufficient sunlight to power motor 42 or that battery 84 is sufficiently charged to do so, or both, solar panel switch 80, and battery switch 86 are actuated which causes motor 42 to rotate fan blade assembly 46 in the chosen direction. Switching blower switch 88 to the opposite position causes motor 42 to reverse direction, this causing fan blade assembly 46 to rotate in the opposite direction. This permits blower 14 to act as either a blower or an exhaust fan according to what type of soil remediation is desired. With the exception of brief periodic inspections, system 2 should not require ongoing service or maintenance.

A comparison test was conducted to get an idea of the magnitude of the increase in efficiency which results from using venturi surface 22 and flow-straightening supports 40. In one test a conventional 4 inch (10 cm) in-line blower rated for 240 cfm at 12 volts dc was selected. The motor from the conventional blower was used with a similar fan blade assembly to create a blower similar to that shown in FIG. 3. Using a Tri-Sense anemometer (Cole-Porter, model 37000-00), the flow rate at 12 vdc was measured at 481 cfm at about 4100 fpm, about a 100% increase.

The invention has been described as it relates to blower 14 used with a solar-powered remediation system. The system is light enough that two people can pick it up and place it over the well pipe, typically a 4 inch diameter pipe 6 inches tall. However, blower 14 and all or parts of the remainder of system 2 maybe useful in other circumstances, such as remote sampling of air for determining levels of air pollution, a fan system for a bathroom vent, and blowing fresh air into confined areas such as mines, valve boxes, storage lockers, etc.

Modification and variation can be made to the disclosed embodiment without departing from the subject of the invention as defined in the following claims.

What is claimed is:

1. A high efficiency blower comprising:

a body having an inner, venturi surface aligned with a flow axis through the body, said venturi surface having first and second ends and a throat between the ends;

a motor/fan assembly comprising a motor and a fan blade assembly mounted to a shaft extending from the motor, said fan blade assembly comprising at least one fan blade having a tip radius;

the motor/fan assembly mounted within the body by a support extending between the motor/fan assembly and the body;

said at least one fan blade having first and second fan blade sides; and said support comprising at least one flow-straightening support comprising:

leading and trailing edges; and first and second lateral sides extending between the leading and trailing edges and oriented generally parallel with the flow axis.

2. The blower according to claim 1 wherein said first lateral side has a surface area at least equal to the surface area of said first fan blade side.

3. The blower according to claim 1 wherein the body has a length L and said support has radially inner and outer axial dimensions, said outer lateral dimension being about $\frac{1}{3}$ to $\frac{2}{3}$ of L and said inner axial dimension being about $\frac{1}{16}$ to $\frac{3}{16}$ of L.

4. The blower according to claim 1 wherein the fan blade is located generally at the throat of the venturi surface.

5. A solar-powered blower system comprising:

a housing;

a high efficiency blower contained within the housing comprising:

a body having an inner, venturi surface aligned with a flow axis through the body, said venturi surface having first and second ends and a throat between the ends;

a motor/fan assembly comprising a motor and a fan blade assembly mounted to a shaft extending from the motor, said fan blade assembly comprising at least one fan blade having a tip radius;

the motor/fan assembly mounted within the body by a support extending between the motor/fan assembly and the body;

said at least one fan blade having first and second fan blade sides; and said support comprising at least one flow-straightening support comprising: leading and trailing edges; and first and second lateral sides extending between the leading and trailing edges and oriented generally parallel with the flow axis;

a solar panel; and an electricity storage and control assembly electrically coupling the blower and the solar panel to supply the blower with electrical energy.

6. The blower system according to claim 5 wherein the solar panel and the electricity storage and control system are mounted to the housing so the blower system is a self-contained, unitary system.

7. A solar-powered blower system comprising:

a housing;

a high-efficiency blower, capable of moving at least 170 cfm of air at about 2000 fpm using no more than 7.5 watts of power, mounted to the housing;

a solar panel; and an electricity storage and control assembly electrically coupling the blower and the solar panel to supply the blower with electrical energy; and wherein the solar panel and the electricity storage and control system are mounted to the housing so the blower is a self-contained, unitary system.

8. The blower system according to claim 7 further comprising a well pipe connector coupled to the blower and the solar-powered blower system is a solar-powered soil remediation system.

* * * * *